US012637310B2

(12) United States Patent
Nakagawa

(10) Patent No.: US 12,637,310 B2
(45) Date of Patent: May 26, 2026

(54) SHEET FEEDING APPARATUS AND IMAGE FORMING APPARATUS

(71) Applicant: CANON KABUSHIKI KAISHA, Tokyo (JP)

(72) Inventor: Hiroyuki Nakagawa, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 190 days.

(21) Appl. No.: 18/321,949

(22) Filed: May 23, 2023

(65) Prior Publication Data

US 2023/0382671 A1 Nov. 30, 2023

(30) Foreign Application Priority Data

May 31, 2022 (JP) ..... 2022-088745

(51) Int. Cl.
*B65H 3/14* (2006.01)
*B65H 3/66* (2006.01)

(52) U.S. Cl.
CPC ..... *B65H 3/14* (2013.01); *B65H 3/66* (2013.01)

(58) Field of Classification Search
CPC ... B65H 3/66; B65H 3/54; B65H 3/48; B65H 2301/51256
See application file for complete search history.

(56) References Cited

U.S. PATENT DOCUMENTS 7,869,104 B2 * 1/2011 Murakami ..... B65H 1/04 271/274
8,141,864 B2 * 3/2012 Fukumoto ..... B65H 3/56 271/97
12,110,203 B2 * 10/2024 Ando ..... B65H 3/54

FOREIGN PATENT DOCUMENTS

JP 2006256819 A 9/2006
JP 2006321629 A 11/2006
JP 4158631 B2 * 10/2008
JP 2014009090 A 1/2014

OTHER PUBLICATIONS

Translation of JP-4158631-B2 (Year: 2026).*

* cited by examiner

*Primary Examiner* — Howard J Sanders
(74) *Attorney, Agent, or Firm* — ROSSI, KIMMS & McDOWELL LLP

(57) ABSTRACT

A sheet feeding apparatus includes a supporting portion configured to support sheets, a feeding member configured to feed the sheets, an air blower unit configured to blow air to separate the sheets, and a side end regulating member including a regulating surface, an air outlet port through which the air from the air blower unit is blown out, a first restriction member movable to a protruding position and to a retracting position, and a second restriction member disposed downstream of the first restriction member in the feeding direction, the second restriction member being fixed to a position where the second restriction member protrudes inward in the sheet width direction with respect to the regulating surface so as to restrict the excessive floating of the sheets.

18 Claims, 8 Drawing Sheets

SHEET FEEDING APPARATUS AND IMAGE FORMING APPARATUS

BACKGROUND OF THE INVENTION

Field of the Invention

The present invention relates to a sheet feeding apparatus that feeds a sheet, and an image forming apparatus that forms an image on a sheet.

Description of the Related Art

In recent years, demand for a printed product of high aesthetical feeling and high image quality using a coated paper sheet, cardboard, or the like has increased for also image forming apparatuses of an electrophotographic system used in offices. However, when using a coated paper sheet or cardboard, it is difficult to separate and feed a sheet from a sheet bundle in a stacked state as compared with typical plain paper sheets or recycled paper sheets for offices.

Japanese Patent Laid-Open No. 2006-256819 discloses a technique for assisting separation of sheets by blowing air to a side end of a sheet bundle set on a manual feed tray. Japanese Patent Laid-Open No. 2006-321629 discloses, for the configuration in which air is blown to a side end of a sheet bundle, providing an upper end guide that restricts excessive floating of the sheets and retracting the upper end guide from above the sheet bundle in the case of not performing the air blowing.

To enhance the sheet separation effect of the air blowing, it is desirable that the air widely spreads through a gap between sheets, and to achieve this, disposing, in a dispersed manner, a plurality of restriction portions that restrict excessive floating of the sheets can be considered. However, if a plurality of restriction portions are provided, there is a possibility that the settability of the sheets deteriorates depending on the positions of the restriction portions. In addition, if each of the plurality of restriction portions is configured to be retractable as the upper guide of Japanese Patent Laid-Open No. 2006-321629, the structure of the apparatus is complicated.

SUMMARY OF THE INVENTION

The present invention provides a sheet feeding apparatus and an image forming apparatus that can achieve settability and separation performance of sheets simultaneously by a simple configuration.

According to an aspect of the invention, a sheet feeding apparatus includes a supporting portion configured to support sheets, a feeding member configured to feed the sheets supported on the supporting portion in a feeding direction, an air blower unit configured to blow air to separate the sheets supported on the supporting portion, and a side end regulating member including a regulating surface configured to face an end portion of each of the sheets in a sheet width direction orthogonal to the feeding direction and regulate a position of each of the sheets in the sheet width direction, an air outlet port through which the air from the air blower unit is blown out toward the end portion of each of the sheets supported on the supporting portion, a first restriction member movable to a protruding position and to a retracting position, the protruding position being a position where the first restriction member protrudes inward in the sheet width direction with respect to the regulating surface such that the first restriction member restricts excessive floating of the sheets, the retracting position being a position where the first restriction member is retracted outward from the protruding position in the sheet width direction, and a second restriction member disposed downstream of the first restriction member in the feeding direction, the second restriction member being fixed to a position where the second restriction member protrudes inward in the sheet width direction with respect to the regulating surface so as to restrict the excessive floating of the sheets.

Further features of the present invention will become apparent from the following description of exemplary embodiments with reference to the attached drawings.

DESCRIPTION OF THE EMBODIMENTS

Embodiments of the present disclosure will be described below with reference to drawings.

In the present disclosure, an "image forming apparatus" is an apparatus that forms an image on a sheet serving as a recording material. Examples of the image forming apparatus include printers, copiers, multifunctional apparatuses, and commercial printers.

Image Forming Apparatus

Figure 1:
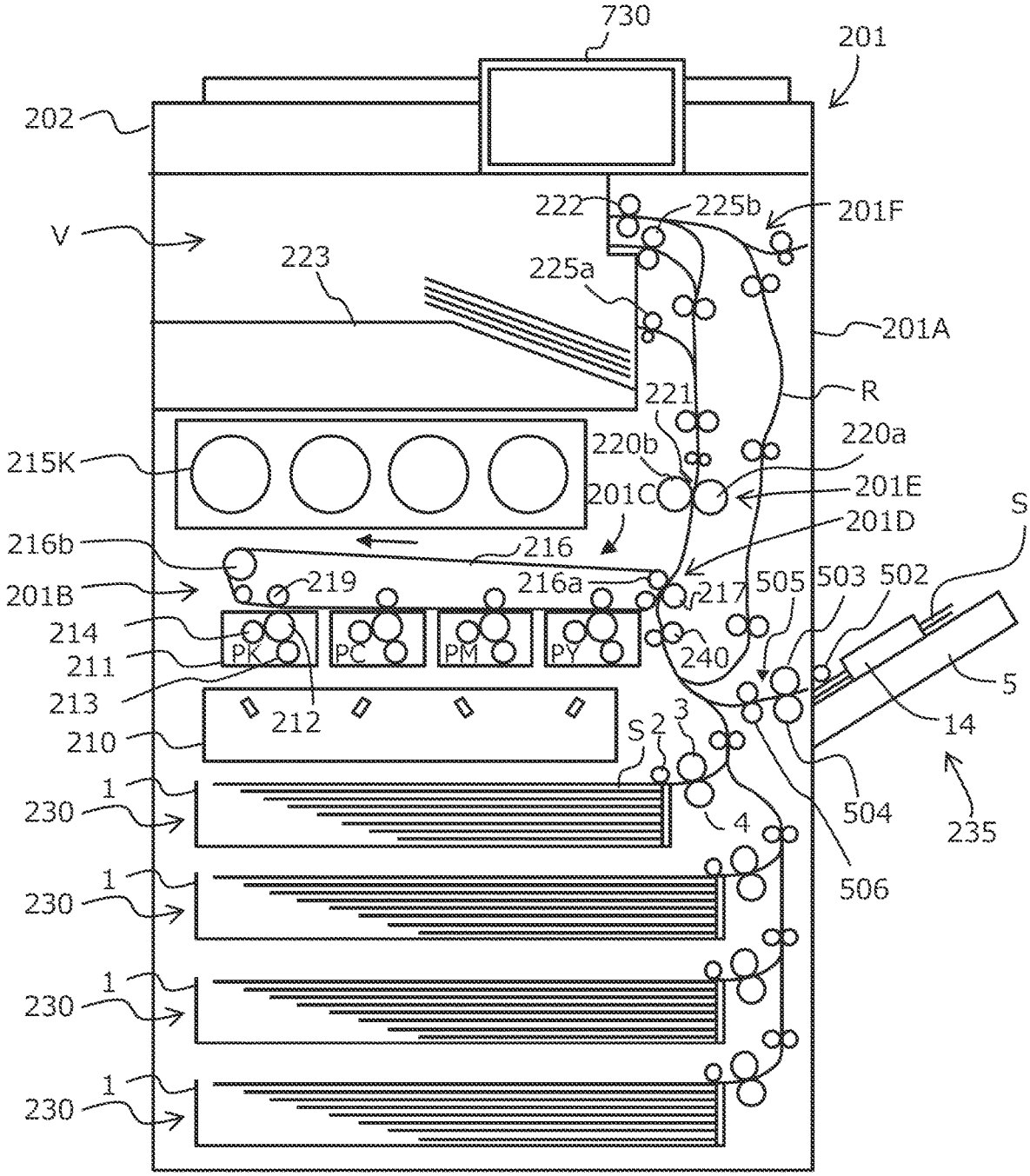
FIG. 1 is a schematic view of an image forming apparatus according to an embodiment.

FIG. 1 is a section view of an image forming apparatus 201 according to an embodiment illustrating a schematic configuration thereof. The image forming apparatus 201 is a laser beam printer of a tandem type and of an intermediate transfer system utilizing an electrophotographic system. The image forming apparatus 201 is capable of forming a full-color image or a monochromatic image on a sheet S on the basis of image data and outputting the sheet S. As the sheet S, a wide variety of sheets of different sizes and materials can be used. Examples of the sheets include paper sheets such as plain paper sheets and cardboards, plastic films, cloths, surface-treated sheet materials such as coated paper sheets, and sheet materials of irregular shapes such as envelopes and index paper sheets.

The image forming apparatus 201 includes an apparatus body 201A accommodating an image forming portion 201B, an image reading apparatus 300 that is disposed above the apparatus body 201A and that reads image information from a document, and a controller that controls the overall operation of the apparatus. The image forming portion 201B serving as an example of an image forming unit includes four process units PY, PM, PC, and PK, an exposing unit 210, a transfer belt 216, and a fixing unit 201E. A discharge space V for discharging sheets is defined between the image reading apparatus 202 and the apparatus body 201A.

The process units PY, PM, PC, and PK each include a photosensitive drum 212 serving as an image bearing member, a charging unit 213 serving as a process unit that acts on the photosensitive drum 212, a developing unit 214, a cleaning unit, and the like. The photosensitive drum 212 is an electrophotographic photosensitive member formed in a drum shape. The developing unit 214 accommodates toner of corresponding one of four colors of yellow, magenta, cyan, and black as developer. The exposing unit 210 serving as a process unit is disposed below the process units PY, PM, PC, and PK.

The transfer belt 216 is an example of an intermediate transfer member. The transfer belt 216 is looped over a driving roller 216*a* and a tension roller 216*b*. On the inner peripheral side of the transfer belt 216, four primary transfer rollers 219 are disposed at positions opposing respective photosensitive drums 212 with the transfer belt 216 therebetween. The transfer belt 216 is rotated in a counterclockwise direction in FIG. 1 by the driving roller 216*a* driven by an unillustrated driving portion. A secondary transfer roller 217 is disposed at a position opposing the driving roller 216*a* with the transfer belt 216 therebetween on the outer peripheral side of the transfer belt 216. A transfer portion 201D serving as a secondary transfer portion is formed as a nip portion between the secondary transfer roller 217 and the transfer belt 216.

The fixing unit 201E is disposed above the transfer portion 201D. The fixing unit 201E is a thermal fixation system including a heating roller 220*b* heated by a heating portion such as a halogen lamp, and a pressurizing roller 220*a* in pressure contact with the heating roller 220*b*. A first discharge roller pair 225*a*, a second discharge roller pair 225*b*, and a duplex reverse portion 201F are disposed above the fixing unit 201E. The duplex reverse portion 201F includes a reverse conveyance roller pair 222 capable of rotating in a normal rotation direction and a reverse rotation direction, and a re-conveyance path R.

An operation portion 730 that receives operation from a user is provided in an upper portion of the image forming apparatus 201. The operation portion 730 includes a display device such as a liquid crystal panel that displays an image, and an input device such as a numerical pad and a print execution button. For example, the user can input setting information of sheets S set in a cassette feed portion 230 and a manual feed portion 235 via the operation portion 730. Examples of the setting information include type, grammage, size, and brand.

The cassette feed portion 230 is disposed in a lower portion of the apparatus body 201A. The manual feed portion 235 is disposed at a side surface portion of the apparatus body 201A. The cassette feed portion 230 and the manual feed portion 235 are each an example of a sheet feeding apparatus that feeds a sheet.

The cassette feed portion 230 includes a cassette 1 serving as a sheet accommodating portion that accommodates the sheets S, and a pickup roller 2 serving as a feeding member that feeds the sheets S from the cassette 1. In addition, the cassette feed portion 230 includes a separation roller pair including a feed roller 3 and a retard roller 4 as a separation conveyance portion for separating the sheets S fed by the pickup roller 2 from each other. The retard roller 4 applies a frictional force in a direction opposite to the feeding direction to the sheets S in a nip portion between the feed roller 3 and the retard roller 4, and thus allows only the one sheet S that is in contact with the feed roller 3 to pass through the nip portion.

Image Forming Operation

The controller of the image forming apparatus 201 starts an image forming operation in the case where image data has been received from the outside, or in the case where an instruction to execute a copying operation is given and image data read from the document by the image reading apparatus 300 is received. In the image forming operation, the process units PY, PM, PC, and PK each form a toner image on the surface of the photosensitive drum 212 by an electrophotographic process. That is, when the process units PY, PM, PC, and PK are requested for formation of toner images, the photosensitive drums 212 are rotationally driven, and the charging units 213 uniformly charge the surface of the photosensitive drums 212. The exposing unit 210 radiates laser light onto the photosensitive drums 212 on the basis of the image data received by the controller from the outside, or the image data obtained by reading the document by the image reading apparatus 300. As a result of this, the surface of the photosensitive drums 212 is exposed, and electrostatic latent images are formed. The developing units 214 supply developer including toner to the photosensitive drums 212, and thus the electrostatic latent images are developed into toner images.

The toner images formed by the process units PY, PM, PC, and PK are transferred onto the transfer belt 216 through primary transfer by the primary transfer rollers 219. In the case of forming a full-color image, the primary transfer is performed such that the toner images of the respective colors are superimposed on each other on the transfer belt 216, and thus a color image is formed on the transfer belt 216. Attached matter such as toner remaining on the photosensitive drums 212 is removed by the cleaning unit of each of the process units PY, PM, PC, and PK.

The sheets S are fed one by one from the cassette feed portion 230 or the manual feed portion 235 in parallel with the operation of the image forming portion 201B and conveyed to the registration roller pair 240. The registration roller pair 240 corrects the skew of the sheet S, and then conveys the sheet S to the transfer portion 201D at a timing synchronized with the operation of the image forming portion 201B. Then, in the transfer portion 201D, the toner image is transferred from the transfer belt 216 onto the sheet S through secondary transfer by the secondary transfer roller 217 to which a transfer voltage is applied.

The sheet S having passed through the transfer portion 201D is delivered to the fixing unit 201E. The fixing unit 201E heats and pressurizes the toner image on the sheet S while nipping and conveying the sheet S between the heating roller 220*b* and the pressurizing roller 220*a*. As a result of this, an image fixed to the sheet S is obtained. To be noted, due to the adhesive force of the melted toner, a force to stick to the heating roller 220*b* is generated on the sheet S. If the stiffness of the sheet S is low, since the sheet S can be wound up by the rotating heating roller 220*b*, a separation plate 221 for separating the sheet S from the heating roller 220*b* is provided on the downstream side of the heating roller 220*b*.

In the case of simplex printing, the sheet S having passed through the fixing unit 201E is discharged to the discharge space V by the first discharge roller pair 225*a* or the second discharge roller pair 225*b*, and is supported on a discharge tray 223. In the case of duplex printing, the sheet S on a first surface of which an image has been formed by passing through the transfer portion 201D and the fixing unit 201E is reversed by the reverse conveyance roller pair 222, and is conveyed again to the image forming portion 201B through the re-conveyance path R. Then, the sheet S passes through the transfer portion 201D and the fixing unit 201E again, and thus an image is formed on a second surface thereof. Then, the sheet S is discharged to the discharge space V by the first discharge roller pair 225*a* or the second discharge roller pair 225*b*, and is supported on the discharge tray 223.

In the description above, the image forming portion 201B is an example of an image forming unit, and an electrophotographic unit of a direct transfer system or an image forming unit of an inkjet system or an offset printing system may be used.

Manual Feed Portion

Figure 2:
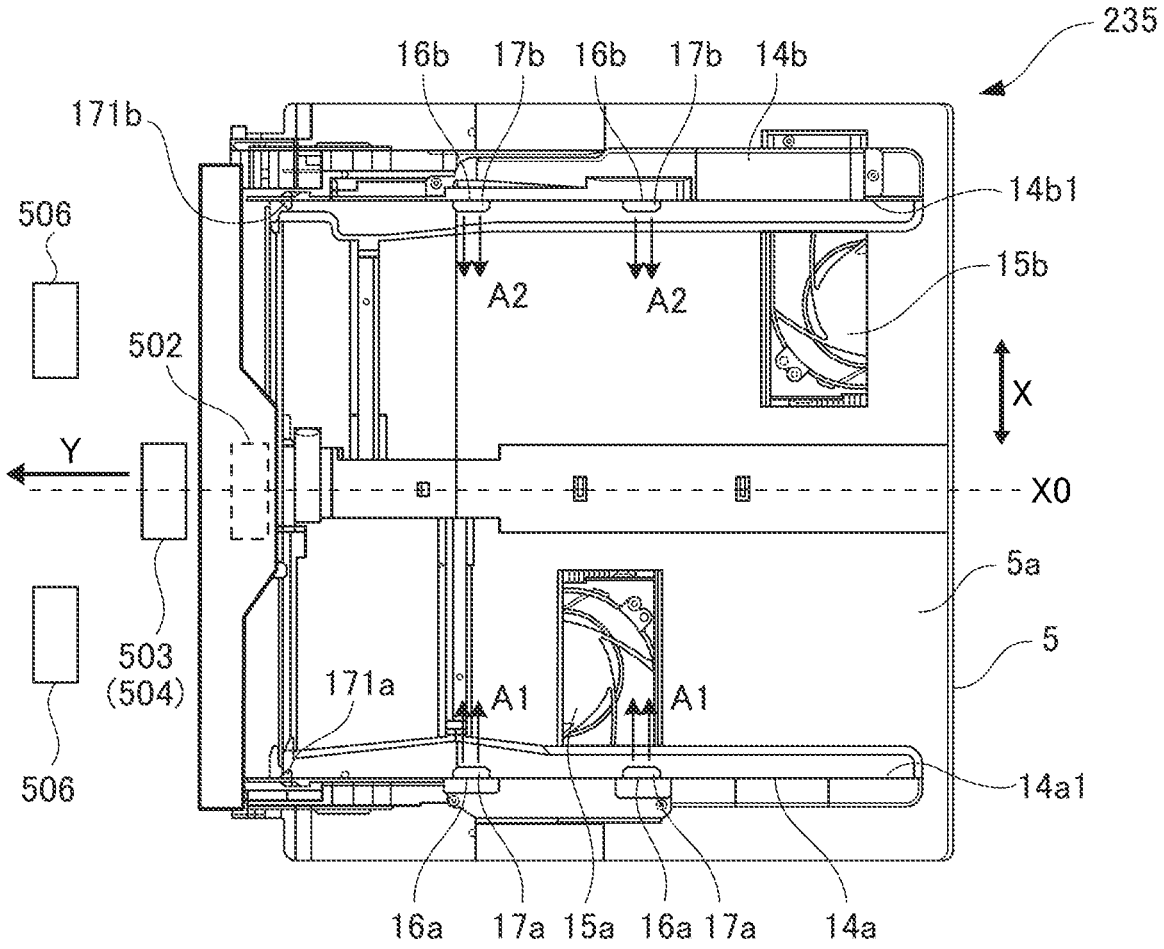
FIG. 2 is a diagram illustrating a manual feed portion according to the embodiment as viewed from above.

The manual feed portion 235 including an air blower portion will be described with reference to FIG. 2. FIG. 2 is a diagram illustrating the manual feed portion 235 as viewed from above. The manual feed portion 235 is configured such that the user sets sheets of a needed amount therein when using the image forming apparatus 201, unlike the cassette feed portion 230 capable of accommodating a large amount of sheets. Therefore, the cassette feed portion 230 is suitable for use of sheets of plain paper of a regular size that are used frequently, and the manual feed portion 235 is suitable for use of sheets such as coated paper sheets and long sheets that are used less frequently.

In the description below, a "feeding direction Y" is a direction in which the sheet is delivered out by a pickup roller 502 from a feed tray 5. A "sheet width direction X" is a direction along the sheets supported on the feed tray 5 and orthogonal to the feeding direction Y.

The manual feed portion 235 includes the feed tray 5, the pickup roller 502, a feed roller 503, a retard roller 504, side end guides 14*a* and 14*b*, and air blower fans 15*a* and 15*b*.

The feed tray 5 is a supporting portion that supports sheets. The feed tray 5 includes a support surface 5*a* serving as a placement surface that supports the lower surface of the sheets. The feed tray 5 is movable to a position where the feed tray 5 is housed in a side surface portion of the apparatus body 201A of the image forming apparatus 201, and to a position where the feed tray 5 protrudes outward from the apparatus body 201A. That is, the feed tray 5 is openable and closable. The user can set sheets on the feed tray 5 from outside the image forming apparatus 201 in a state in which the feed tray 5 is open. The feed tray 5 is also referred to as a manual feed tray or a multi-purpose tray.

The pickup roller 502 is an example of a feeding member that feeds sheets. The pickup roller 502 is disposed above the support surface 5*a* of the feed tray 5. The pickup roller 502 is pivotably supported by a roller holder 507 serving as a holding member. The roller holder 507 is swingable about a rotation axis of the feed roller 503. As a result of the roller holder 507 swinging, the pickup roller 502 moves to a feeding position where the pickup roller 502 abuts the upper surface of the sheets supported on the feed tray 5 and to a standby position where the pickup roller 502 is separated upward from the sheets. The feeding position also serves as a contact position and a lower position, and the standby position also serves as a separation position and an upper position. When the pickup roller 502 rotates in the feeding position, a sheet is delivered out in the feeding direction Y from the feed tray 5. For example, a mechanism that attracts a sheet to the belt by a negative pressure generated by a fan and conveys the sheet by rotating the belt may be used in place of the pickup roller 502.

The feed roller 503 conveys the sheet received from the pickup roller 502 further in the feeding direction Y A conveyance roller pair 506 that conveys a sheet received from the feed roller 503 toward the registration roller pair 240 illustrated in FIG. 1 is disposed downstream of the feed roller 503.

The retard roller 504 is in pressure contact with the feed roller 503, and forms a separation nip between the feed roller 503 and the retard roller 504. In addition, a driving force in a direction opposite to the rotation of the feed roller 503 is input to the retard roller 504 via a torque limiter. The retard roller 504 is an example of a separation member that separates sheets by a frictional force. For example, a roller member coupled to a fixed shaft via a torque limiter, or a pad-shaped elastic member that is in contact with the feed roller 503 may be used.

The side end guides 14*a* and 14*b* are side end regulating members (regulation plates) that regulate the sheet position in the sheet width direction X. In the present embodiment, a pair of side end guides 14*a* and 14*b* facing each other in the sheet width direction X is used. The side end guide 14*b* that is on the rear side is an example of a second side end guide facing the side end guide 14*a*. The side end guides 14*a* and 14*b* respectively include regulating surfaces 14*a*1 and 14*b*1 as surfaces on the inside in the sheet width direction X. "Inside" in the sheet width direction X for one of the side end guides is the side on which the other of the side end guides is disposed, and "outside" in the sheet width direction X is the side opposite to the side on which the other of the side end guides is disposed. The regulating surfaces 14*a*1 and 14*b*1 are surfaces extending in the feeding direction Y and erecting approximately orthogonally from the feed tray 5 as viewed in the feeding direction Y The regulating surfaces 14*a*1 and 14*b*1 regulate the sheet position in the sheet width direction X by abutting end portions in the sheet width direction X (side ends) of the sheets supported on the feed tray 5.

Figure 3:
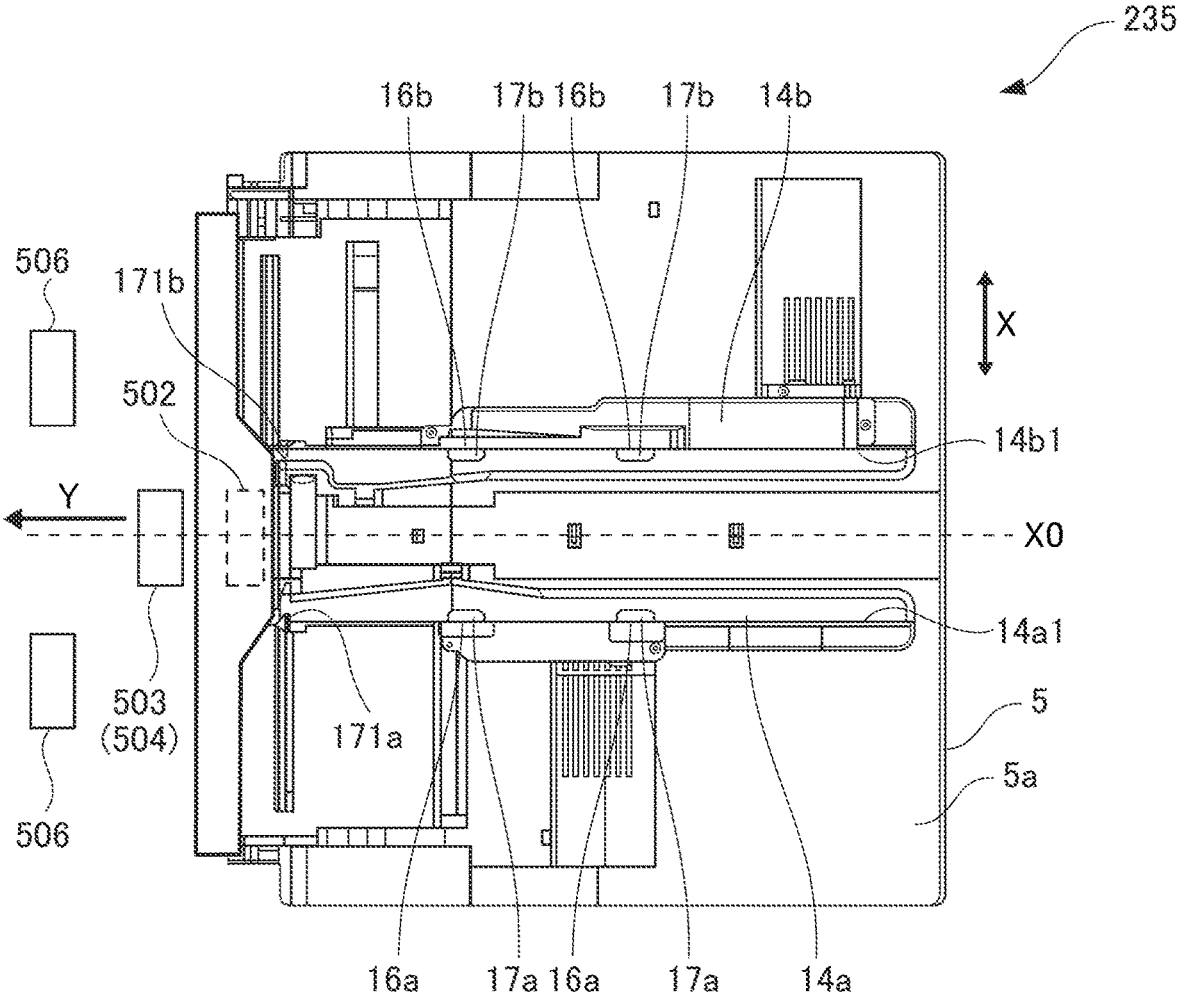
FIG. 3 is a diagram illustrating the manual feed portion according to the embodiment as viewed from above.

The side end guides 14*a* and 14*b* are movable in the sheet width direction X with respect to the feed tray 5. The side end guides 14*a* and 14*b* are coupled to each other via an interlocking mechanism such as a rack-and-pinion mechanism, and move in an interlocked manner such that the distances thereto from a center position X0 in the sheet width direction X are equal. The center position X0 is a position serving as a standard in the sheet width direction X for sheets fed by the manual feed portion 235. FIG. 2 illustrates a state in which the side end guides 14*a* and 14*b* have been moved to the most outward positions, that is, side end positions of a sheet of the maximum size that can be fed from the manual feed portion 235. FIG. 3 illustrates a state in which the side end guides 14*a* and 14*b* have been moved to the most inward positions that is, side end positions of a sheet of the minimum size that can be fed from the manual feed portion 235.

One of the side end guides 14*a* and 14*b*, the side end guide 14*a* positioned on the front side in the image forming apparatus 201, is provided with an operation tab for moving the side end guides 14*a* and 14*b*. The user can suppress the skew and displacement of the sheets by moving the side end guides 14*a* and 14*b* to positions matching the size of the sheets to be used.

The air blower fans 15*a* and 15*b* are each an example of an air blower unit that blows air to assist separation of sheets supported on the feed tray 5. The air blower fans 15*a* and 15*b* generate an airflow by, for example, taking in the outside air through an air intake port provided in a bottom surface of the feed tray 5. The air blower fans 15*a* and 15*b* of the present embodiment are disposed under the support surface 5*a* of the feed tray 5. The air blower fans 15*a* and

15*b* are each a fan motor in which a fan body that generates an airflow by rotation and a motor that drives the fan body are integrated.

Although a sirocco fan (forward-bladed centrifugal fan) is used for each of the air blower fans 15*a* and 15*b* in the present embodiment, for example, a propeller fan (axial fan) may be used as an air blower fan. In addition, the air blower unit may be disposed above the support surface 5*a* of the feed tray 5.

The side end guides 14*a* and 14*b* respectively include air outlet ports 16*a* and 16*b* for blowing air from the air blower fans 15*a* and 15*b* to side ends of the sheets on the feed tray 5. The air outlet ports 16*a* and 16*b* are openings respectively formed in the regulating surfaces 14*al* and 14*b*1 of the side end guides 14*a* and 14*b*. In addition, the air outlet ports 16*a* and 16*b* are connected to air discharge portions of the air blower fans 15*a* and 15*b* via ducts (air flow path) provided in the side end guides 14*a* and 14*b*.

When the air blower fans 15*a* and 15*b* are operated, air blows out inward in the sheet width direction X from the air outlet ports 16*a* and 16*b* as indicated by flow lines A1 and A2.

The side end guides 14*a* and 14*b* further respectively include upstream restriction members 17*a* and 17*b* as restriction members (excessive floating restriction members) for restricting excessive floating of the sheets caused by the air. The side end guides 14*a* and 14*b* further respectively include downstream restriction members 171*a* and 171*b* as restriction members (excessive floating restriction members). These restriction members will be described later.

Feeding Operation of Manual Feed Portion

Next, a feeding operation in which the manual feed portion 235 feeds a sheet will be described with reference to FIG. 2. The user sets sheets on the feed tray 5 in advance, and inputs setting information of the set sheets via the operation portion 730.

When the user presses the print execution button, the air blower fans 15*a* and 15*b* start operating to blow air, and air is blown on the side ends of the sheets from the air outlet ports 16*a* and 16*b*. As a result of this air entering a gap between sheets, the sheets float and thus the adhesive force between the sheets is reduced. As a result of this, the manual feed portion 235 can stably feed sheets one by one while separating the sheets from each other, even in the case of using sheets whose surface is highly smooth and thus for which sticking of sheets is likely to occur, such as coated paper sheets. To be noted, the controller of the image forming apparatus 201 may be configured to operate the air blower fans 15*a* and 15*b* only in the case of determining that the separation by the air blowing is necessary, for example, in the case of coated paper sheets, on the basis of the setting information of the sheets.

Then, when a predetermined time has elapsed since the start of air blowing by the air blower fans 15*a* and 15*b*, the rotational driving of the pickup roller 502, the feed roller 503, and the like is started, the roller holder 507 swings, and thus the pickup roller 502 moves from the standby position to the feeding position. Then, the uppermost sheet in contact with the pickup roller 502 is delivered to the feed roller 503, separated from the other sheets at the separation nip to be conveyed further, and is delivered to the registration roller pair 240 illustrated in FIG. 1 by the conveyance roller pair 506. The flow of the sheet conveyance and image formation after this is as described above. To be noted, a sheet sensor 505 illustrated in FIG. 1 detects a sheet between the feed roller 503 and the conveyance roller pair 506, and thus the conveyance timing of the sheet is monitored.

Layout of Restriction Members

The air outlet ports 16*a* and 16*b* and the restriction members 17*a*, 17*b*, 171*a*, and 171*b* provided in the side end guides 14*a* and 14*b* will be described in detail. First, the layout of the air outlet ports 16*a* and 16*b* and the restriction members 17*a*, 17*b*, 171*a*, and 171*b* will be described with reference to FIG. 4.

In the present embodiment, the side end guide 14*a* on the front side of the image forming apparatus 201 includes two upstream restriction members 17*a* and one downstream restriction member 171*a*. The two upstream restriction members 17*a* are arranged at an interval in the feeding direction Y The downstream restriction member 171*a* is disposed downstream of and at an interval from a downstream one of the upstream restriction members 17*a* in the feeding direction Y The downstream restriction member 171*a* is preferably disposed in a downstream end portion region Ya of the regulating surface 14*a*1 in the feeding direction Y Here, the downstream end portion region Ya in the feeding direction Y refers to the most downstream region in the case of equally dividing the entirety of the regulating surface 14*a*1 into four regions in the feeding direction Y.

The two upstream restriction members 17*a* are disposed at the two air outlet ports 16*a* provided in the side end guide 14*a*. In the illustrated example, the upstream ones of the upstream restriction members 17*a* and the air outlet ports 16*a* are disposed upstream of the center position Y0 of the regulating surface 14*a*1 in the feeding direction Y, and the downstream ones of the upstream restriction members 17*a* and the air outlet ports 16*a* are disposed downstream of the center position Y0 of the regulating surface 14*a*1. To be noted, layout of the upstream restriction members 17*a* and the downstream restriction member 171*a* is not limited to the illustrated layout. In addition, a configuration in which only part of the plurality of air outlet ports 16*a* is provided with a restriction member may be employed.

Similarly, the side end guide 14*b* on the rear side includes two upstream restriction members 17*b* and one downstream restriction member 171*b*. The two upstream restriction members 17*b* are arranged at an interval in the feeding direction Y The downstream restriction member 171*b* is disposed downstream of and at an interval from the downstream one of the upstream restriction members 17*b* in the feeding direction Y The downstream restriction member 171*b* is preferably disposed in the downstream end portion region Ya of the regulating surface 14*b*1 in the feeding direction Y.

The two upstream restriction members 17*b* are disposed at the two air outlet ports 16*b* provided in the side end guide 14*b*. In the illustrated example, the upstream ones of the upstream restriction members 17*b* and the air outlet ports 16*b* are disposed upstream of the center position Y0 of the regulating surface 14*b*1 in the feeding direction Y, and the downstream ones of the upstream restriction members 17*b* and the air outlet ports 16*b* are disposed downstream of the center position Y0 of the regulating surface 14*b*1. To be noted, layout of the upstream restriction members 17*b* and the downstream restriction member 171*b* is not limited to the illustrated layout. In addition, a configuration in which only part of the plurality of air outlet ports 16*b* is provided with a restriction member may be employed.

As will be described, the upstream restriction members 17*a* and 17*b* are movable to protruding positions where the upstream restriction members 17*a* and 17*b* protrude inward in the sheet width direction X with respect to the regulating surfaces 14*a*1 and 14*b*1 so as to suppress excessive floating of the sheets, and to retracting positions where the upstream restriction members 17*a* and 17*b* are retracted outward from the protruding positions in the sheet width direction X. The retracting positions of the present embodiment are positions where the upstream restriction members 17*a* and 17*b* do not protrude inward in the sheet width direction X with respect to the regulating surfaces 14*a*1 and 14*b*1. The retracting positions are preferably set such that the entirety of the upstream restriction members 17*a* and 17*b* is retracted more outward than the regulating surfaces 14*a*1 and 14*b*1 in the sheet width direction X. To be noted, a configuration in which the surfaces on the inside of the upstream restriction members 17*a* and 17*b* positioned at the retracting positions in the sheet width direction X are substantially flush with the regulating surfaces 14*a*1 and 14*b*1 except for minute difference such as production tolerance may be employed.

The downstream restriction members 171*a* and 171*b* are fixed to positions protruding inward in the sheet width direction X with respect to the regulating surfaces 14*a*1 and 14*b*1. The downstream restriction members 171*a* and 171*b* can be molded as members respectively integrated with the regulating surfaces 14*a*1 and 14*b*1 of the side end guides 14*a* and 14*b*.

The downstream one of the two upstream restriction members 17*a* is an example of a first restriction member. The downstream restriction member 171*a* is an example of a second restriction member disposed downstream of the first restriction member in the feeding direction.

Similarly, the downstream one of the two upstream restriction members 17*b* is an example of a first restriction member. The downstream restriction member 171*b* is an example of a second restriction member disposed downstream of the first restriction member in the feeding direction.

In the present embodiment, second air outlet ports 16*a* and 16*b* are respectively disposed upstream of and at an interval from the air outlet ports 16*a* and 16*b* that are disposed on the downstream side in the feeding direction Y Accordingly, the upstream ones of the upstream restriction members 17*a* and 17*b* serving as third restriction members are additionally disposed upstream of the downstream ones of the upstream restriction members 17*a* and 17*b* serving as first restriction members. The upstream ones of the upstream restriction members 17*a* and 17*b* are, similarly to the downstream ones of the upstream restriction members 17*a* and 17*b*, movable to second protruding positions where the upstream ones of the upstream restriction members 17*a* and 17*b* protrude inward in the sheet width direction X with respect to the regulating surfaces 14*a*1 and 14*b*1 so as to suppress excessive floating of the sheets, and to second retracting positions where the upstream ones of the upstream restriction members 17*a* and 17*b* are retracted outward from the second protruding positions in the sheet width direction X. As a result of this, the excessive floating of the sheets can be more reliably suppressed.

In the present embodiment, the positions in the feeding direction Y where the upstream restriction members 17*a* on the front side are provided respectively correspond to positions in the feeding direction Y where the upstream restriction members 17*b* on the rear side are provided. The positions in the feeding direction Y where the air outlet ports 16*a* on the front side are provided respectively correspond to positions in the feeding direction Y where the air outlet ports 16*b* on the rear side are provided. In addition, the position in the feeding direction Y where the downstream restriction member 171*a* on the front side is provided corresponds to the position in the feeding direction Y where the downstream restriction member 171*b* on the rear side is provided. Therefore, the posture of the sheet can be made more stable in a configuration in which air is blown from both sides in the sheet width direction X.

Air Outlet Ports and Upstream Restriction Members

The air outlet ports 16*a* and 16*b* and the movable upstream restriction members 17*a* and 17*b* disposed at the air outlet ports 16*a* and 16*b* will be described with reference to FIGS. 5, 6A, and 6B.

Figure 5:
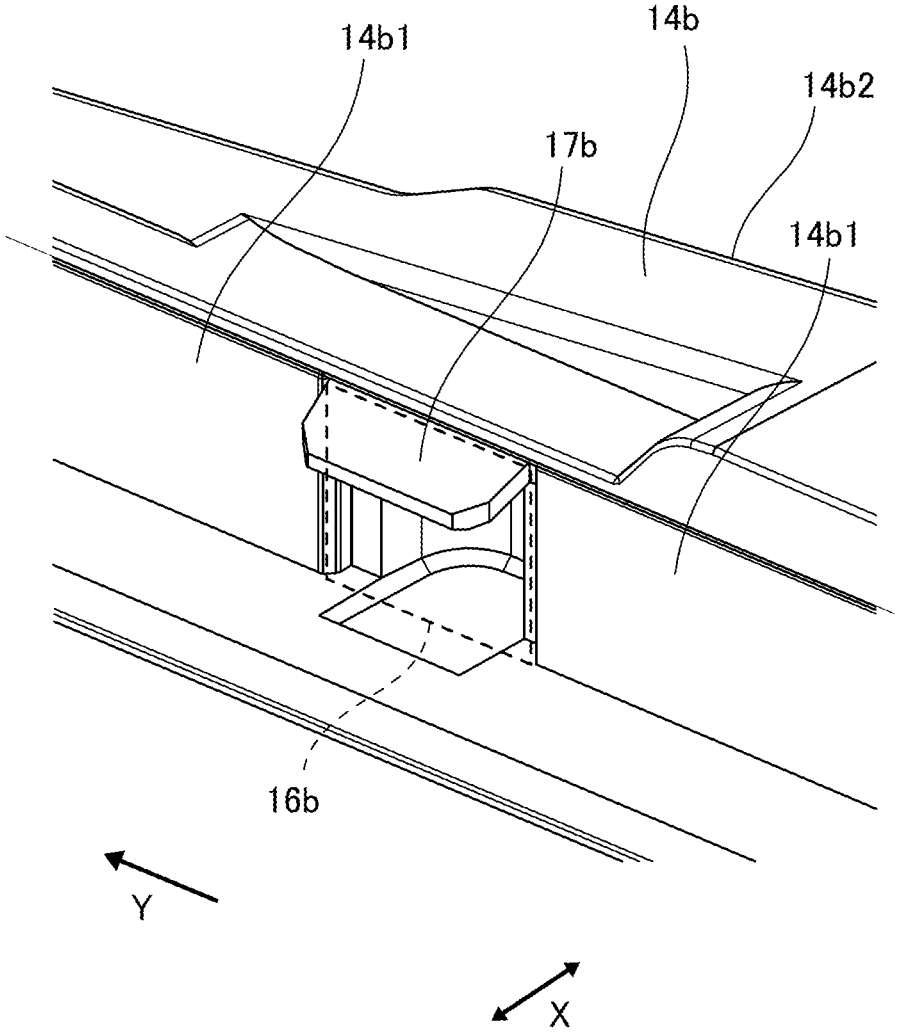
FIG. 5 is a perspective view of an air outlet port and an upstream restriction member of a side end guide according to the embodiment.

FIG. 5 is a perspective view of an air outlet port 16*b* and an upstream restriction member 17*b* of the side end guide 14*b*. FIG. 6A is a section view of the side end guide 14*b* as viewed from the downstream side in the feeding direction Y in a state in which the upstream restriction members 17*a* are in the retracting positions. FIG. 6B is a section view of the side end guide 14*b* as viewed from the downstream side in the feeding direction Y in a state in which the upstream restriction members 17*a* are in the protruding positions.

As illustrated in FIG. 5, the upstream restriction members 17*b* are disposed in the space inside the air outlet ports 16*b*. The upstream restriction members 17*b* are pivotably supported by the side end guide 14*b*, and pivot about an axis of the feeding direction Y.

Figure 6B:
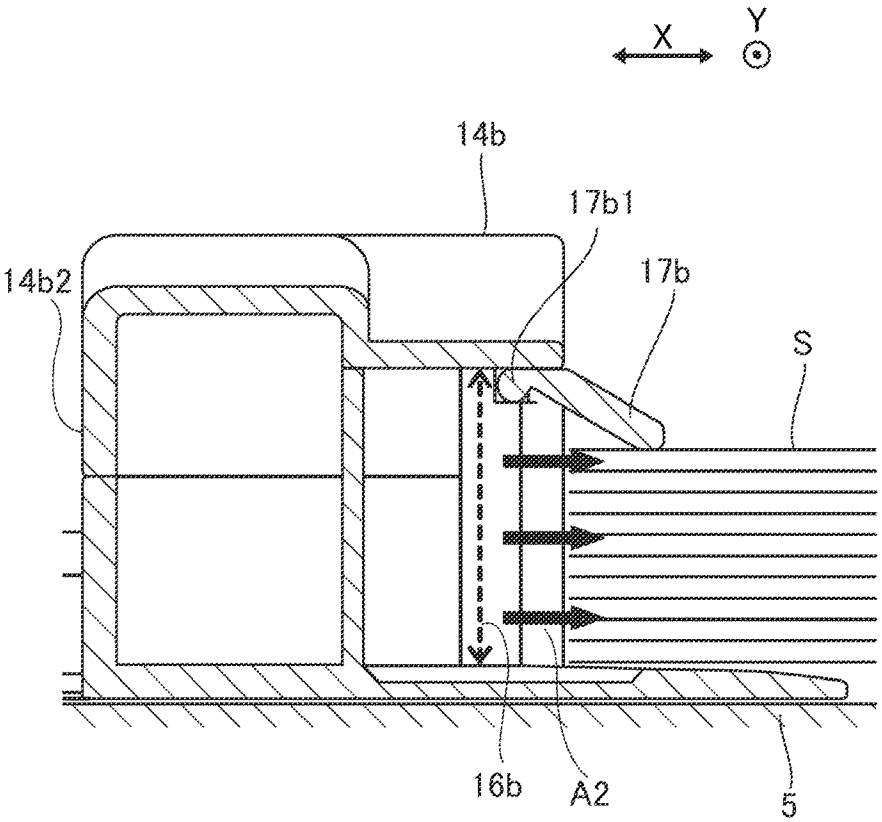
FIGS. 6A and 6B are each a section view of aside end guide according to the embodiment.
Figure 6A:
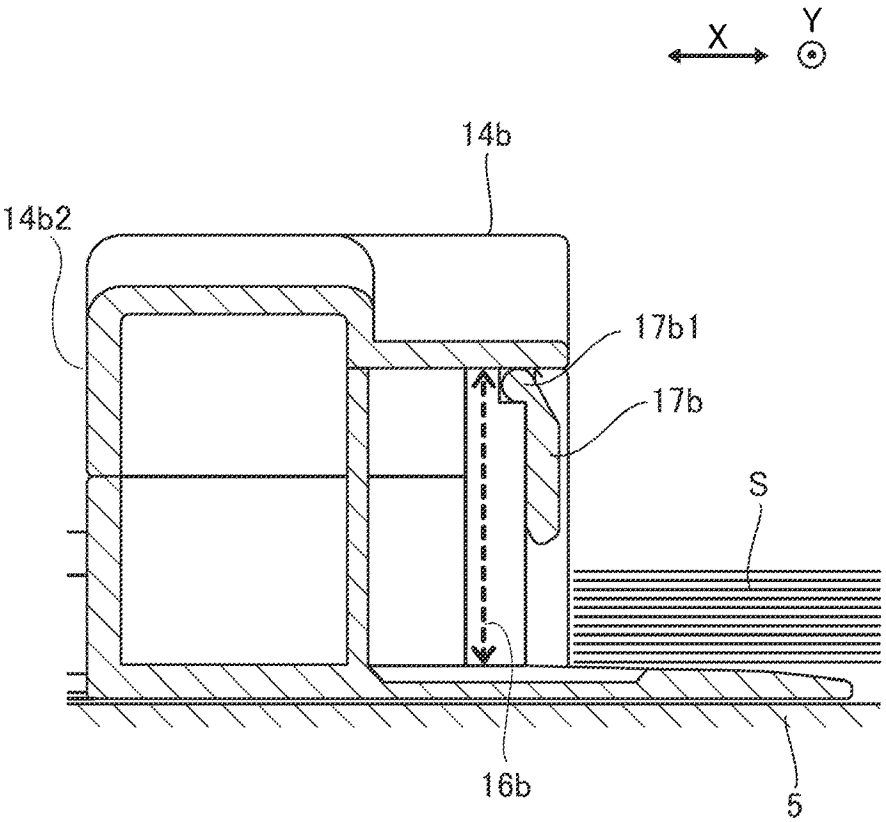

As illustrated in FIG. 6A, the upstream restriction members 17*b* are configured not to protrude inward in the sheet width direction X with respect to the regulating surface 14*b*1 of the side end guide 14*b* in the case of being positioned in the retracting positions. Therefore, the upstream restriction members 17*b* are not likely to be obstacles for setting and removing the sheets on and from the feed tray 5. In the present embodiment, the upstream restriction members 17*b* remain in the retracting positions by the weight thereof in a period in which the air blower fan 15*b* is not blowing air.

As illustrated in FIG. 6B, the upstream restriction members 17*b* are configured to protrude inward in the sheet width direction X with respect to the regulating surface 14*b*1 of the side end guide 14*b* in the case of being positioned in the protruding positions. In the present embodiment, the upstream restriction members 17*b* are moved from the retracting positions to the protruding positions by the air pressure in the case where the air from the air blower fan 15*b* indicated by a flow line B2 blows out from the air outlet ports 16*b*.

While FIGS. 5, 6A, and 6B illustrate the side end guide 14*b* on the rear side, the upstream restriction members 17*b* on the front side have substantially the same configuration except that the positional relationship in the sheet width direction X is reversed.

In the case where the sheets S are floated by blowing air thereto, the upper surface of the uppermost sheet S abuts the upstream restriction members 17*a* and 17*b* positioned in the protruding positions. The upstream restriction members 17*a* and 17*b* abut abutment surfaces provided on the side end guides 14*a* and 14*b*, and thus pivoting thereof beyond the angle of FIG. 6B is restricted. Therefore, the floating height of the uppermost sheet S is restricted by the upstream restriction members 17*a* and 17*b* positioned in the protruding positions.

As a result of this, a possibility that the sheet S floats upward beyond the upper end height of the air outlet ports 16*a* and 16*b* and the separation effect of the air blowing cannot be obtained can be reduced, thus the separation effect of air blowing can be more reliably exerted, and a possibility of occurrence of multiple feeding can be reduced.

To be noted, the lower end height of the upstream restriction members 17*a* and 17*b* positioned in the retracting positions illustrated in FIG. 6A are set to be higher than the maximum stacking height of the sheets on the feed tray 5.

The maximum stacking height of the sheets is, for example, displayed by sticking a sticker indicating the maximum stacking height to the regulating surfaces 14*a*1 and 14*b*1 of the side end guides 14*a* and 14*b*. As a result of this, a possibility that pivoting of the upstream restriction members 17*a* and 17*b* is hindered by the sheets set on the feed tray 5 can be reduced.

In addition, in the case of changing whether or not to perform the air blowing in accordance with the type of the sheets, the maximum stacking height of the sheets (for example, coated paper sheets) for which the air blowing is performed may be set to be lower than the maximum stacking height of the sheets (for example, plain paper sheets) for which the air blowing is not performed. In addition, a message warning about the maximum stacking height may be displayed in the case where coated paper sheets are selected in the operation portion 730.

Downstream Restriction Members

Figure 7:
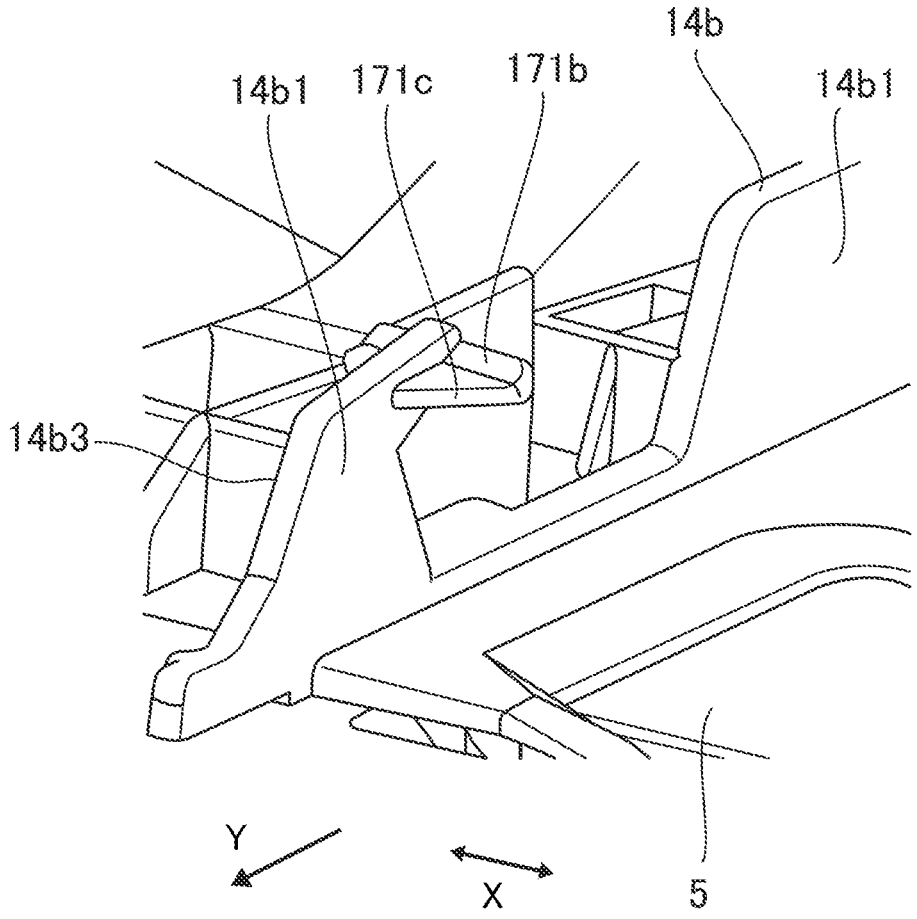
FIG. 7 is a perspective view of a downstream restriction member of aside end guide according to the embodiment.

FIG. 7 is a perspective view of the downstream restriction member 171*b* provided on the side end guide 14*b* on the rear side. The downstream restriction member 171*b* is fixed to the side end guide 14*b* unlike the upstream restriction members 17*b*, and always protrudes inward in the sheet width direction X with respect to the regulating surface 14*b*1. The downstream restriction member 171*a* provided on the side end guide 14*a* provided on the front side has substantially the same configuration as the downstream restriction member 171*b* illustrated in FIG. 7 except that the positional relationship in the sheet width direction X is reversed.

The downstream restriction members 171*a* and 171*b* are not configured to be movable unlike the upstream restriction members 17*a* and 17*b*, therefore have simple structures, and can be miniaturized.

In the case where the sheets S are floated by the air blowing, the upper surface of the uppermost sheet S abuts the downstream restriction members 171*a* and 171*b* at positions downstream of the upstream restriction members 17*a* and 17*b* in the feeding direction y and thus excessive floating thereof is restricted. Therefore, an end portion of the sheet being lifted up so much that the air dissipates can be suppressed, and thus the air blown from the air outlet ports 16*a* and 16*b* can be widely spread in a gap between sheets. Therefore, the separation effect of the air blowing can be made more stable than in the configuration in which the downstream restriction members 171*a* and 171*b* are not provided.

In addition, although the downstream restriction members 171*a* and 171*b* always protrude with respect to the regulating surfaces 14*a*1 and 14*b*1 of the side end guides 14*a* and 14*b*, the downstream restriction members 171*a* and 171*b* are not likely to hinder the setting operation or the removal operation of the sheets because the downstream restriction members 171*a* and 171*b* are positioned downstream of the upstream restriction members 17*a* and 17*b* in the feeding direction Y Particularly, since the manual feed portion 235 is used in the present embodiment, the user normally sets the sheets by inserting the sheets in the feed tray 5 from the upstream side to the downstream side in the feeding direction Y Therefore, the downstream restriction members 171*a* and 171*b* are even less likely to hinder the setting operation and the like of the sheets.

Therefore, according to the present embodiment, the settability and separation performance of the sheets can be achieved simultaneously by a simple configuration.

In addition, when a corner portion on the leading end side of the sheets is excessively floated by the air blowing, there is a risk that the corner portion collides with a conveyance guide or the like and corner folding or a conveyance failure occurs. However, in the present embodiment, the excessive floating of the corner portion is restricted by the downstream restriction members 171*a* and 171*b*. As a result of this, more stable sheet conveyance can be realized.

Figure 4:
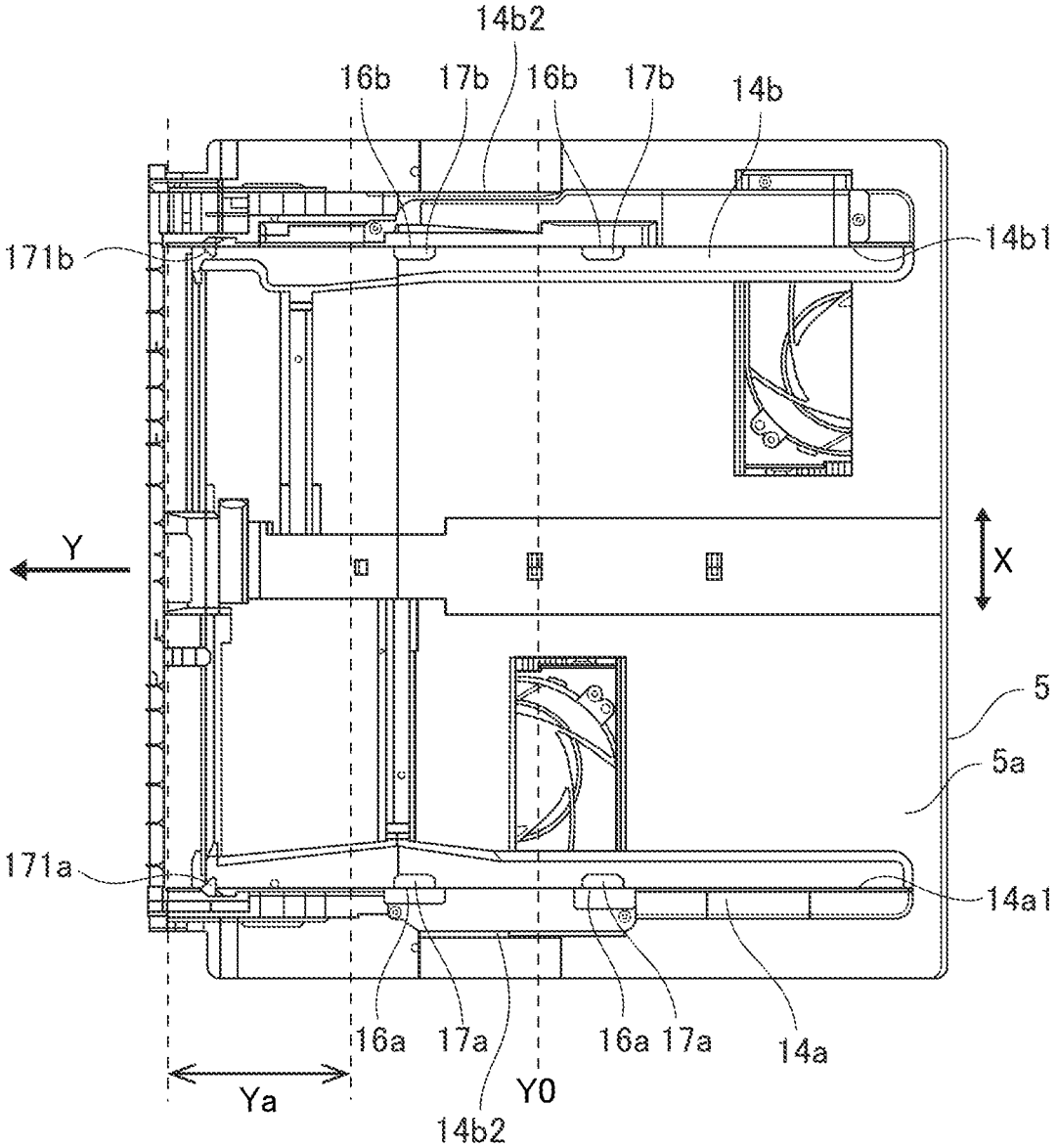
FIG. 4 is a diagram for describing a layout of restriction members according to the embodiment.

In the case where the feed tray 5 is viewed from above, the protruding area of each of the upstream restriction members 17*a* and 17*b* with respect to corresponding one of the regulating surfaces 14*a*1 and 14*b*1 is larger than the protruding area of each of the downstream restriction members 171*a* and 171*b* with respect to corresponding one of the regulating surfaces 14*a*1 and 14*b*1 as illustrated in FIG. 4. The protruding area of each of the upstream restriction members 17*a* and 17*b* is an area of a portion of the upstream restriction member 17*a* or 17*b* positioned in a protruding position protruding inward in the sheet width direction X with respect to corresponding one of the regulating surfaces 14*a*1 and 14*b*1. The protruding area of each of the downstream restriction members 171*a* and 171*b* is an area of a portion of the downstream restriction member 171*a* or 171*b* protruding inward in the sheet width direction X with respect to corresponding one of the regulating surfaces 14*a*1 and 14*b*1. According to the configuration described above, excessive floating of a portion of a sheet near the center thereof can be reliably suppressed by the upstream restriction members 17*a* and 17*b* while making the downstream restriction members 171*a* and 171*b* less likely to hinder the setting operation of the sheets or the like.

Positional Relationship when Tray is Housed

Figure 8B:
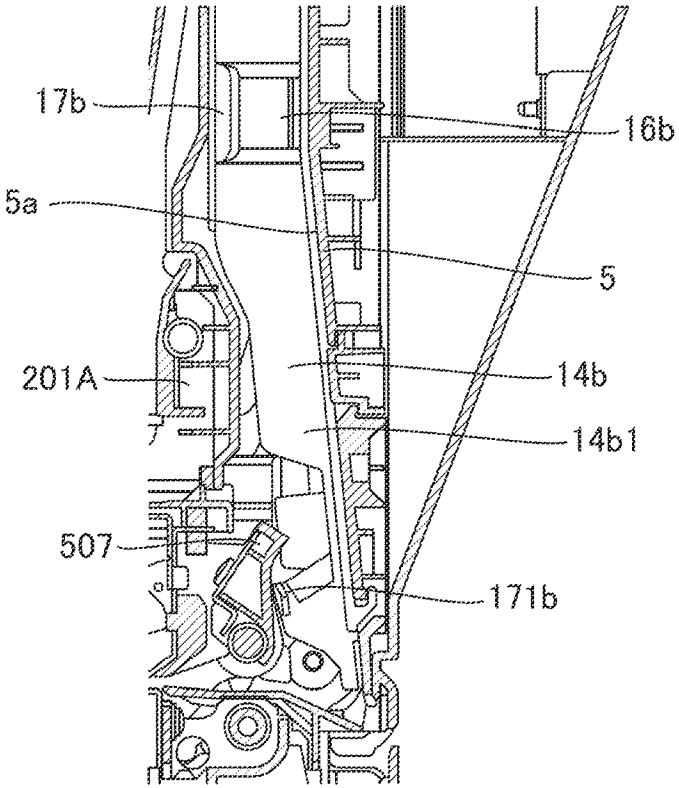
FIGS. 8A and 8B are each a section view of the manual feed portion according to the embodiment.
Figure 8A:
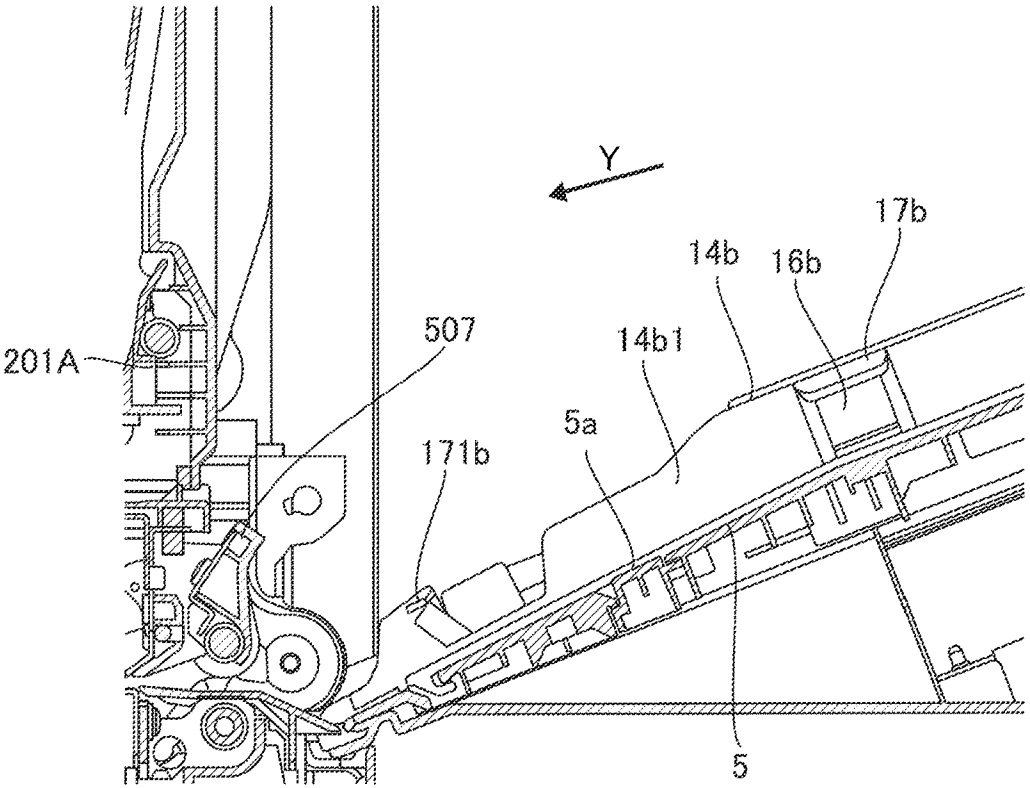

A positional relationship of the downstream restriction members 171*a* and 171*b* with other members when the feed tray 5 is housed in the apparatus body 201A will be described. FIG. 8A is a section view of the manual feed portion 235 taken along a virtual plane orthogonal to the sheet width direction X in a state in which the feed tray 5 is open. FIG. 8B is a section view of the manual feed portion 235 taken along a virtual plane orthogonal to the sheet width direction X in a state in which the feed tray 5 is closed.

As described above, the downstream restriction members 171*a* and 171*b* are respectively provided on the side end guides 14*a* and 14*b* movable in the sheet width direction X. Therefore, in a state in which the side end guides 14*a* and 14*b* have been moved inward as illustrated in FIG. 3, the downstream restriction members 171*a* and 171*b* are positioned near the pickup roller 502 and the roller holder 507 covering the pickup roller 502. If the feed tray 5 is closed in this state, the downstream restriction members 171*a* and 171*b* further come closer to the pickup roller 502 and the roller holder 507.

However, the downstream restriction members 171*a* and 171*b* of the present embodiment are fixed to the side end guides 14*a* and 14*b* unlike the upstream restriction members 17*a* and 17*b*, and therefore the size thereof is more reduceable than the upstream restriction members 17*a* and 17*b* that are movable. Therefore, as illustrated in FIG. 8A, the downstream restriction members 171*a* and 171*b* are housed in a space between the feed tray 5 and the apparatus body 201A without coming into contact with the pickup roller 502 or the roller holder 507 even in the state in which the feed tray 5 is closed.

Particularly, in the present embodiment, a configuration in which the upstream restriction members 17*a* and 17*b* are moved by the air pressure of the air from the air blower fans 15*a* and 15*b* is employed. Therefore, as illustrated in FIGS. 4, 6A, and 6B, the side end guides 14*a* and 14*b* need to respectively have wall surfaces 14*a*2 and 14*b*2 at positions more on the outside than the upstream restriction members 17*a* and 17*b* in the sheet width direction X for forming ducts to guide air to the air outlet ports 16*a* and 16*b*.

In contrast, the downstream restriction members 171*a* and 171*b* do not need the ducts. Therefore, the thickness of part of the side end guides 14*a* and 14*b* near the downstream restriction members 171*a* and 171*b* in the sheet width direction X can be made smaller than the thickness of part of the side end guides 14*a* and 14*b* near the upstream restriction members 17*a* and 17*b* in the sheet width direction X. For example, on the downstream side of the downstream restriction member 171*b* in the feeding direction Y in FIG. 7, the thickness of the side end guide 14*b* can be set to a thickness between the regulating surface 14*b*1 and aback surface 14*b*3 thereof.

Therefore, since the downstream restriction members 171*a* and 171*b* are configured not to need the ducts, the interference with members such as the pickup roller 502 is less likely to occur, and thus the freedom of design is improved.

To be noted, as illustrated in FIG. 3, the roller holder 507 has an inclined surface inclined outward in the sheet width direction X toward the downstream side in the feeding direction Y In this case, it is preferable that, as illustrated in FIGS. 3 and 7, end surfaces 171*c* of the downstream restriction members 171*a* and 171*b* are also inclined outward in the sheet width direction X toward the downstream side in the feeding direction Y As a result of this, the interference with members such as the roller holder 507 is less likely to occur, and thus the freedom of design is improved. In addition, if part of the lower surface of the downstream restriction members 171*a* and 171*b* is inclined away from the feed tray 5 toward the upstream side in the feeding direction Y as illustrated in FIG. 7, a situation in which sheets are caught when setting the sheets by inserting the sheets from above in the feeding direction Y can be reduced.

Other Embodiments

In the embodiment described above, a mechanism that is moved by an air pressure of air from an air blower unit has been described as an example of a restriction member that is movable to a protruding position and to a retracting position. Instead of this, for example, a configuration in which the restriction member is urged toward the protruding position by a spring member, the restriction member falls over to the retracting position when setting sheets from above, and the restriction member returns to the protruding position by the urging force of the spring member when the sheets have passed may be employed. Also in the case of using such a restriction member as the upstream restriction member serving as a first restriction member, an advantageous effect similar to that of the embodiment described above can be obtained by configuring the downstream restriction member serving as a second restriction member to be fixed. Alternatively, for example, a configuration in which the upstream restriction member is moved by an actuator such as a solenoid may be employed.

In addition, although a configuration in which a pair of side end guides are each provided with an air blower unit has been described as an example in the embodiment described above, a configuration in which only one of the side end guides is provided with an air blower unit may be employed. In this case, a restriction member that restricts excessive floating of sheets may be disposed only on the side on which excessive floating of the sheets can be caused by the air from the air blower unit. In addition, a configuration in which an air blower unit is fixed to the feed tray 5 or the apparatus body 201A and air is delivered to an air outlet port in a side end guide via a duct following the movement of the side end guide may be employed.

In addition, in the embodiment described above, a sheet feeding apparatus of a manual feed type that is provided in a side surface portion of an image forming apparatus used in an office has been mainly described. The configuration is not limited to this, and the present technique may be applied to the cassette feed portion 230 illustrated in FIG. 1. In addition, in a larger image forming apparatus for commercial use, the present technique may be applied to a sheet feeding apparatus of a manual feed type or a sheet feeding apparatus (optional feeder) used by being coupled to a main body of an image forming apparatus.

As described above, according to the present disclosure, settability and separation performance of sheets can be simultaneously achieved with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-088745, filed on May 31, 2022, which is hereby incorporated by reference herein in its entirety.

What is claimed is:

1. A sheet feeding apparatus comprising:

a supporting portion, including a support surface, configured to support a sheet;

a feeding member configured to feed the sheet supported on the supporting portion in a feeding direction;

an air blower unit configured to blow air toward the sheet supported on the supporting portion; and a side end regulating member including:

a regulating surface configured to face a side end portion of the sheet in a sheet width direction orthogonal to the feeding direction and regulate a position of the sheet in the sheet width direction;

a first restriction member movable to:

a protruding position where the first restriction member protrudes inward in the sheet width direction with respect to the regulating surface such that the first restriction member restricts the sheet, in a state in which the sheet is blown upward by the air from the air blower unit; and a retracting position where the first restriction member is retracted outward from the protruding position in the sheet width direction; and a second restriction member disposed downstream of the first restriction member in the feeding direction, wherein the second restriction member:

is immovable with respect to the regulating surface;

protrudes inward in the sheet width direction with respect to the regulating surface; and is plate shaped with a major surface thereof oriented facing toward the support surface in a direction perpendicular to the support surface and is configured to restrict the sheet by coming in contact with an upper surface of the sheet.

2. The sheet feeding apparatus according to claim 1, wherein the supporting portion is a tray provided at a side surface portion of the sheet feeding apparatus and configured to pivot between a closed position where the tray is closed with respect to the side surface portion and an open position where the feeding member is allowed to feed the sheet.

3. The sheet feeding apparatus according to claim 2, wherein the second restriction member is disposed at a position where the second restriction member does not come into contact with the feeding member, in a state in which the tray is moved from the opened position to the closed position and in a state in which the side end regulating member has been moved to a most inward position in the sheet width direction.

4. The sheet feeding apparatus according to claim 2, further comprising:

a holding member configured to hold the feeding member, wherein the second restriction member is disposed at a position where the second restriction member does not come into contact with the holding member, in a state in which the tray is closed and in a state in which the side end regulating member has been moved to a most inward position in the sheet width direction.

5. The sheet feeding apparatus according to claim 2, wherein:

the side end regulating member includes:

an upstream portion that forms a part of the regulating surface, a downstream portion that forms another part of the regulating surface and that is disposed downstream of the upstream portion in the feeding direction, and a recessed portion formed between the upstream portion and the downstream portion in the feeding direction, the recessed portion providing an upper edge of the side end regulating member that is recessed downward relative to an upper edge of the upstream portion and an upper edge of the downstream portion, the first restriction member is provided in the upstream portion, and the second restriction member is provided in the downstream portion.

6. The sheet feeding apparatus according to claim 5, further comprising:

a holding member configured to hold the feeding member, wherein at least part of the holding member is accommodated in the recessed portion as viewed in the sheet width direction in a state where the tray is in the closed position.

7. The sheet feeding apparatus according to claim 1, wherein:

the air blower unit is a first air blower unit, the side end regulating member is a first side end regulating member, the regulating surface is a first regulating surface, the major surface is a first major surface, the sheet feeding apparatus further comprises:

a second air blower unit configured to blow air toward the sheet supported on the supporting portion; and a second side end regulating member configured to face the first side end regulating member in the sheet width direction and move in the sheet width direction in an interlocked manner with the first side end regulating member, wherein the second side end regulating member includes:

a second regulating surface configured to face a side end portion of the sheet on an opposite side from the first regulating surface in the sheet width direction and to regulate the position of the sheet in the sheet width direction;

a third restriction member movable to:

a position where the third restriction member protrudes inward in the sheet width direction with respect to the second regulating surface such that the third restriction member restricts the sheet, in a state in which the sheet is blown upward by the air from the second air blower unit; and a position where the third restriction member is retracted outward in the sheet width direction; and a fourth restriction member disposed downstream of the third restriction member in the feeding direction, wherein the fourth restriction member:

is immovable with respect to the second regulating surface;

protrudes inward in the sheet width direction with respect to the second regulating surface; and is plate shaped with a second major surface thereof oriented facing toward the support surface in the direction perpendicular to the support surface and is configured to restrict the sheet by coming in contact with the upper surface of the sheet.

8. The sheet feeding apparatus according to claim 1, wherein the first restriction member:

is disposed rotatably at the side end regulating member;

is moved from the retracting position to the protruding position by an air pressure of the air from the air blower unit; and remains in the retracting position by a weight of the first restriction member in a period in which the air blower unit is not blowing air.

9. The sheet feeding apparatus according to claim 1, further comprising:

an air outlet port disposed at the regulating surface and through which the air from the air blower unit is blown out toward the side end portion of the sheet supported on the supporting portion;

a duct provided at a position that coincides with a position of the first restriction member in the feeding direction and that is more on outside than the regulating surface in the sheet width direction, the duct being configured to guide the air from the air blower unit to the air outlet port, wherein the duct is not provided at a position that coincides with a position of the second restriction member in the feeding direction and that is more on outside than the regulating surface in the sheet width direction.

10. The sheet feeding apparatus according to claim 1, wherein the second restriction member is positioned in an end portion region, on a downstream side in the feeding direction, of the regulating surface.

11. The sheet feeding apparatus according to claim 1, further comprising:

a first air outlet port disposed at the regulating surface and through which the air from the air blower unit is blown out toward the side end portion of the sheet supported on the supporting portion; and a second air outlet port disposed at the regulating surface, which is provided upstream of the first air outlet port in the feeding direction, and through which the air from the air blower unit is blown out toward the side end portion of the sheet supported on the supporting portion, wherein the side end regulating member further includes an upstream restriction member disposed upstream of the first restriction member in the feeding direction, and wherein the upstream restriction member is movable to a second protruding position and to a second retracting position, the second protruding position being where the upstream restriction member protrudes inward in the sheet width direction with respect to the regulating surface such that the upstream restriction member restricts the sheet, in the state in which the sheet is blown upward by the air from the air blower unit, the second retracting position being where the upstream restriction member is retracted outward from the second protruding position in the sheet width direction.

12. The sheet feeding apparatus according to claim 11, wherein:

the first restriction member is disposed downstream of a center position of the regulating surface in the feeding direction, and the upstream restriction member is disposed upstream of the center position of the regulating surface in the feeding direction.

13. The sheet feeding apparatus according to claim 1, wherein as viewed from above the supporting portion, an area of a portion of the first restriction member protruding inward in the sheet width direction with respect to the regulating surface, in a state in which the first restriction member is positioned in the protruding position, is larger than an area of a portion of the second restriction member protruding inward in the sheet width direction with respect to the regulating surface.

14. An image forming apparatus comprising:

the sheet feeding apparatus according to claim 1; and an image forming unit configured to form an image on a sheet fed from the sheet feeding apparatus.

15. The sheet feeding apparatus according to claim 1, wherein at least part of the major surface is substantially parallel to the support surface.

16. The sheet feeding apparatus according to claim 1, wherein the major surface includes a parallel portion parallel to the support surface and an inclined portion provided upstream of the parallel portion in the feeding direction and inclined upward away from the support surface as the major surface extends upstream in the feeding direction.

17. The sheet feeding apparatus according to claim 1, wherein the second restriction member is integrally molded with the regulating surface.

18. The sheet feeding apparatus according to claim 1, wherein the second restriction member is configured to guide the sheet such that the sheet passes below the major surface while the feeding member is feeding the sheet.

* * * * *